US005572300A

United States Patent [19]

Yamasa et al.

[11] Patent Number: 5,572,300

[45] Date of Patent: Nov. 5, 1996

[54] DEVELOPING DEVICE CONTAINING FOR STORING DEVELOPER HAVING ZONER AND CARRIER

[75] Inventors: Hideo Yamasa, Yamatokoriyama; Yasuhiro Takai, Sakurai; Atsushi Ueda, Shiki-gun; Hirokazu Tanaka, Osaka, all of Japan

[73] Assignee: Sharp Kabushiki Kaisha, Osaka, Japan

[21] Appl. No.: 208,431

[22] Filed: Mar. 9, 1994

[30] Foreign Application Priority Data

Mar. 9, 1993 [JP] Japan ..... 5-047901
May 18, 1993 [JP] Japan ..... 5-116198

[51] Int. Cl.[6] ..... G03G 15/08

[52] U.S. Cl. ..... 399/260

[58] Field of Search ..... 355/260, 245, 355/246, 200, 208, 298, 251, 253, 259; 118/653, 657, 658, 688–691; 222/DIG. 1

[56] References Cited

U.S. PATENT DOCUMENTS

| | | | |
|---|---|---|---|
| 4,625,895 | 12/1986 | Tsukano | 222/63 |
| 4,768,055 | 8/1988 | Takamatsu et al. | 355/200 |
| 4,825,244 | 4/1989 | Hediger | 355/260 |
| 4,873,549 | 10/1989 | Tada et al. | 355/206 |
| 5,095,338 | 3/1992 | Hayes, Jr. et al. | 355/246 |
| 5,109,254 | 4/1992 | Oka et al. | 355/200 |
| 5,237,373 | 8/1993 | Aimoto et al. | 355/298 |
| 5,430,532 | 7/1995 | Ueda et al. | 355/260 |
| 5,450,178 | 9/1995 | Kawashima et al. | 355/260 |

FOREIGN PATENT DOCUMENTS 2-21591 5/1990 Japan .

*Primary Examiner*—Thu Anh Dang
*Attorney, Agent, or Firm*—David G. Conlin; Peter F. Corless

[57] ABSTRACT

The present invention provides in a preferred embodiment a developer container having a supply and discharge shaft which is driven and rotated in a direction by a supply and discharge shaft motor, a supply screw mounted on one of the ends of the supply and discharge shaft for bringing unused developer in a developer supply container into a developer container, and a discharge screw mounted on the other end of the supply and discharge shaft for discharging the developer in the developer container through a developer discharge opening. With this structure, the ratio of replacing old developer with new developer in the developer container is controlled in the desired manner, and the charging property of the developer is maintained substantially uniform. Additionally, since the replacement efficiency of the developer is improved, the consumption of the developer is reduced. Moreover, even when a copying machine is tilted, a large amount of developer is unlikely to be discharged.

12 Claims, 10 Drawing Sheets

DEVELOPING DEVICE CONTAINING FOR STORING DEVELOPER HAVING ZONER AND CARRIER

FIELD OF THE INVENTION

The present invention relates to a developing device which stores a two-component developer including toner and carrier, and supplies the toner to the surface of a photoreceptor in an electrophotographic apparatus such as a copying machine so as to develop an electrostatic latent image on the photoreceptor surface into a visible form.

BACKGROUND OF THE INVENTION

For example, a developing device which develops an electrostatic latent image on a photoreceptor surface into a visible form using a two-component developer (hereinafter just referred to as the developer) including carrier and toner is often used in dry-type copying machines. In such a developing device, the toner is consumed during a developing operation, but the carrier is not consumed and remains in the developing device. Thus, the carrier deteriorates as the frequency of stirring the carrier and the toner in the developing device increases. Consequently, a resin coating layer on the surface of the carrier is removed and the toner adheres to the surface thereof. As a result, the charging property of the developer gradually deteriorates.

In order to solve such a problem, for example, Japanese Publication for Examined Patent Application No. 21591/1990 discloses a device which restrains the deterioration of the charging property by continuously supplying a small amount of carrier to the developing device as well as toner that is consumed during a developing operation. In this device, when the developer is increased excessively in a developer container by the supply of the carrier, it overflows and is discharged through a discharge opening in a wall of the developer container. The discharged developer is collected in a developer collecting container. By successively suppling the toner and carrier and discharging the developer in a repeated manner, the deteriorated developer in the developer container is replaced with newly supplied toner and carrier. With this structure, the charging property of the developer is maintained and the deterioration of the image quality of a copy is restrained.

However, since the deteriorated developer in the developer container overflows or is discharged through the discharge opening in the wall of the developer container, a desired replacement ratio of deteriorated developer and newly supplied developer is not maintained. As a result, the charging property of the developer varies and the image quality of a copy deteriorates.

For example, when a plurality of copies of a high density document are repeatedly produced, the toner consumption is excessively increased and the amount of developer in the developer container is decreased. However, even if the carrier is provided in this state, the developer does not overflow as it does not reach the discharge opening. Namely, the deteriorated developer can never be discharged.

On the other hand, if the carrier is supplied when a large amount of developer is stored in the developing device, the newly supplied carrier is likely to overflow instantly. Thus, the replacement of the deteriorated carrier and the newly supplied carrier is not carried out in a desired manner.

As described above, with this structure it is difficult to supply the carrier and discharge the developer in a desired manner, and the deterioration of the image quality of a copy due to the decreased charging property of the developer is not satisfactorily compensated.

Moreover, in the latter case, an excessive amount of carrier needs to be supplied in order to compensate for an undesired discharge caused when the newly supplied carrier overflows, resulting in an increase in the consumption of developer.

Furthermore, for example, if a copying machine incorporating the above-mentioned developing device is moved, a large amount of developer tends to be discharged through the discharge opening as the copying machine is tilted or receives impact by the movement. Thus, the developer is wastefully discharged, and the charging property of the developer is considerably varied due to the excessive reduction in the amount of developer in the developer container, resulting in a considerable change in the image quality of a copy.

U.S. Pat. No. 5,095,338 discloses a developing device including a permanent magnet mounted in the vicinity of the discharge opening of the developer container. The magnetic field of the permanent magnet keeps the developer from flowing down from the discharge opening. A current is caused to flow through an electromagnet disposed adjacent to the permanent magnet until a detector which is mounted on an upper position of the side wall of the developer container senses that the developer in the developer container comes below a predetermined height. Consequently, the magnetic field produced by the permanent magnet is weakened by the magnetic field of the electromagnet, and the developer is automatically discharged through the discharge opening.

With this structure, however, since the supplying of new developer to the developer container and the discharging of the developer from the developer container are performed independently, it is necessary to control the supplying of the developer and the discharging of the developer separately. It is thus difficult to accurately control the replacement ratio of the old and new developer in a simplified manner. Accordingly, it is difficult to keep a charging property of the developer and to maintain favorable image quality of a copy.

SUMMARY OF THE INVENTION

It is an object of the present invention to provide a developing device capable of restraining a lowering of the charging property of developer and of maintaining good copy quality by accurately replacing deteriorated developer with new developer.

It is another object of the present invention to provide a developing device capable of reducing the consumption of developer by improving the replacement efficiency in supplying and discharging developer.

It is still another object of the present invention to provide a developing device capable of preventing a large amount of developer from being discharged from a developer container when, for example, a copying machine incorporating the developing device therein receives an impact or is tilted at the time it is moved.

In order to achieve the above object, a developing device of the present invention includes a developer container which stores developer and has a developing roller, a developer supply section, and a developer discharge opening. The developing roller is mounted rotatably and supplies the developer to a photoreceptor. The developer supply section stores developer to be supplied to the developer container. The developer discharge opening discharges the developer from the developer container. Also, the developer container has a supply transporting section for transporting the developer in the developer supply section into the developer container, and a discharge transporting section for transporting the developer in the developer container from the discharge opening. At least one of the supply transporting section and the discharge transporting section is driven by driving means, and the driving force is transmitted to the other transporting section. Namely, both of the supply transporting section and the discharge transporting section are driven by the driving force of the same driving means.

With this structure, when the driving means is activated, the developer in the developer supply section is brought into the developer container by the supply transporting section and the developer in the developer container is discharged through the developer discharge opening by the discharge transporting section. By repeatedly performing the supplying and discharging operations, deteriorated developer in the developer container is replaced with new developer.

More specifically, an amount of developer corresponding to the driving time of the supply transporting section and of the discharge transporting section is supplied and discharged. Therefore, even when the total amount of developer in the developer container is changed and the surface level thereof is varied, the developer is accurately discharged to replace the developer in the developer container. It is thus possible to control the replacement ratio in a desired manner when consecutively replacing the deteriorated developer in the developer container with newly supplied unused developer. As a result, the charging property is kept at a substantially uniform level, and good copy quality is maintained.

Moreover, with this structure, the possibility that developer which has just been supplied is discharged is reduced in comparison with the discharging structure using an overflowing mechanism. Consequently, the replacement efficiency of developer is improved and the consumption of developer is reduced.

Furthermore, in the developing device, the supplying of developer and the discharging of developer are carried out by the supply transporting section and the discharge transporting section driven by the driving means. Thus, unlike the discharging structure using an overflowing mechanism, even when a copying machine incorporating the developing device receives an impact or is tilted at the time it is moved, a large amount of developer is unlikely to be discharged from the developer container. It is therefore possible to prevent the charging property from being varied by a considerable change in the amount of developer, maintaining good copy quality.

Another developing device of the present invention is constructed in the same manner as the above-mentioned first developing device, and the ratio of toner to carrier in the developer in the developer supply section is set to a target ratio of toner to carrier for the developer in the developer container.

With this structure, since the ratio of toner to carrier (hereinafter just referred to as the toner concentration) in the developer to be supplied to the developer container is equal to a target toner concentration for the developer in the developer container, the toner concentration in the developer in the developer container does not vary from the target value due to the supplying of the developer. Thus, in addition to the effect produced by the first structure of the present invention, the toner concentration in the developer container is easily controlled.

Still another developing device of the present invention is constructed in the same manner as the first developing device, and the supplying of toner to the developer container by toner supplying means is controlled so that the toner concentration in the developer detected by toner concentration detecting means is within an allowable range. The developer container includes controlling means which stops the driving means from being activated when the toner concentration in the developer container detected by the toner concentration detecting means is out of the allowable range.

With this structure, for example, in the condition having less toner than is needed, it is possible to prevent an increased amount of carrier from being discharged by the driven supply and discharge transporting sections in comparison with the condition where the toner concentration is within the allowable range, thereby avoiding a shortage of carrier in the developer container. In the condition having excessive toner, it is also possible to prevent the developer in the developer container from containing an excessive amount of carrier by discharging a reduced amount of carrier by the driven supply and discharge transporting sections in comparison with the condition where the toner concentration is within the allowable range.

In short, in addition to the effect produced by the first structure of the present invention, the charging property of the developer is not changed and the copy quality does not deteriorate even when the toner concentration in the developer container is out of the allowable range.

Still another developing device of the present invention includes a supply and discharge shaft which is driven by the driving means and rotated in one direction. In this developing device, the supply transporting section is provided on one side of the supply and discharge shaft, and the discharge transporting section is provided on the other side thereof.

With this structure, in addition to the effect produced by the first structure of the present invention, it is possible to carry out the supplying and discharging of the developer simultaneously with the rotation of the supply and discharge shaft. As a result, the structure for supplying and discharging developer is simplified.

Still another developing device of the present invention is constructed in the same manner as the first developing device, and the developer container includes a supply shaft having a supply transporting section and a discharge shaft having a discharge transporting section. In this device, one of the supply shaft and the discharge shaft is driven and rotated by the driving means, and the rotation of the shaft is transmitted to the other shaft with a gear ratio of 1 by transmitting means.

With this structure, when the driving means is driven and rotated, the supply shaft and the discharge shaft are rotated at the same speed, and the supplying of developer from the developer supply section and the discharging of developer from the developer discharge opening are simultaneously performed.

Therefore, unlike the structure where, for example, the supply transporting section and the discharge transporting section are mounted on the same shaft, it is not necessary to locate the developer supply section and the developer discharge opening in portions corresponding to the ends of the shaft. Thus, in addition to the effect produced by the first developing device of the present invention, the restriction on the positioning of the developer supply section and the developer discharge opening is eliminated, i.e., the structural restriction on the developing device is eased.

Still another developing device of the present invention is a developing device including a developer container provided with the supply shaft, the discharge shaft, and a partition member having therein communicating holes through which developer is transported toward the discharge transporting section. The diameter of the communicating hole is gradually increased from the upper stream toward the lower stream in the transporting direction of the developer.

With this structure, only the developer which has passed through the communicating holes in the partition member is transported toward the developer discharge opening by the discharge transporting section and is then discharged. Additionally, since the diameter of the communicating hole is gradually increased from the upper stream toward the lower stream in the transporting direction, only fine developer which is the cause of deteriorating copy quality is discharged through the communicating holes in the upper stream.

Thus, in addition to the effects of the developing device including the supply shaft and the discharge shaft, fine developer which deteriorates the copy quality is selectively discharged first and the copy quality is improved.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a vertical cross section of essential sections of a developing device of the present invention.

FIG. 2 is a transverse cross sections of the developing device.

FIG. 3 is a front view schematically showing the entire structure of the developing device.

FIG. 4 is a schematic view showing the entire structure of a copying machine incorporating the developing device.

FIG. 5 is a enlarged cross section of the developing device in the copying machine.

FIG. 6 is a block diagram schematically showing a control structure of the copying machine.

FIG. 7 is a flow chart showing a control operation of a controller in the copying machine with respect to a supply and discharge shaft driving motor.

FIG. 8 is a vertical cross section of essential sections of a developing device of the present invention.

FIG. 9 is a transverse cross sections of the developing device.

FIG. 10 is a schematic view showing the entire structure of a copying machine incorporating the developing device.

FIG. 11 is an enlarged cross section of the developing device in the copying machine.

FIG. 12 is a block diagram schematically showing a control structure of the copying machine.

DETAILED DESCRIPTION OF THE PREFERRED EMBODIMENTS

The following description discusses one embodiment the present invention with reference to FIGS. 1 to 7.

Figure 4:
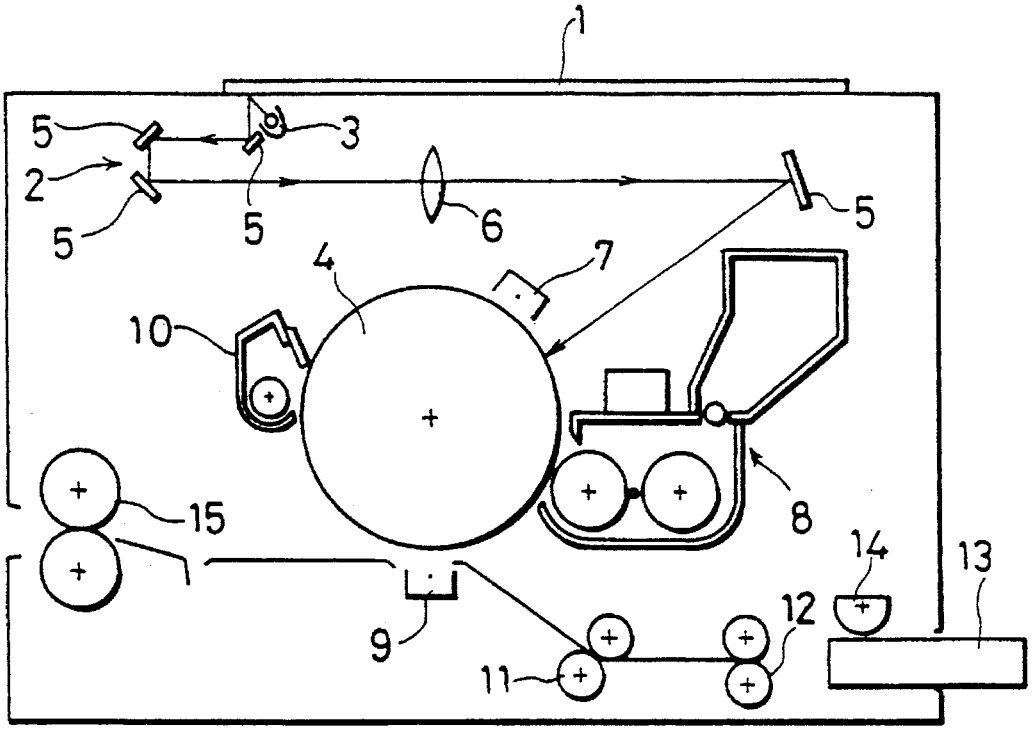

As illustrated in FIG. 4, a copying machine incorporating a developing device of the present invention therein includes a document platen 1 located on an upper surface thereof, and an exposure optical system 2 disposed below the document platen 1. The exposure optical system 2 is formed by a light source lamp 3 which scans a document, not shown, placed on the document platen 1 by applying light to the document, a plurality of reflecting mirrors 5 for directing reflected light from the document toward a photoreceptor 4, and a lens unit 6 disposed on the light path of the reflected light.

Disposed round the photoreceptor 4 are a charger 7 for charging the surface of the photoreceptor 4 to a predetermined potential, an eraser (not shown), a developing device 8 for developing an electrostatic latent image formed on the surface of the photoreceptor 4, a transfer charger 9 for transferring the toner image from the surface of the photoreceptor 4 to a sheet, a cleaning device 10 for collecting residual toner on the surface of the photoreceptor 4, and a discharging device (not shown). Timing rollers 11 for timely supplying a sheet, transporting rollers 12, a sheet feeding cassette 13, and a feed roller 14 are positioned on one side of the photoreceptor 4 from which a sheet is fed toward the photoreceptor 4. A fixing device 15 for fixing the toner image on the sheet is located on the other side of the photoreceptor 4 through which the sheet is discharged.

Figure 5:
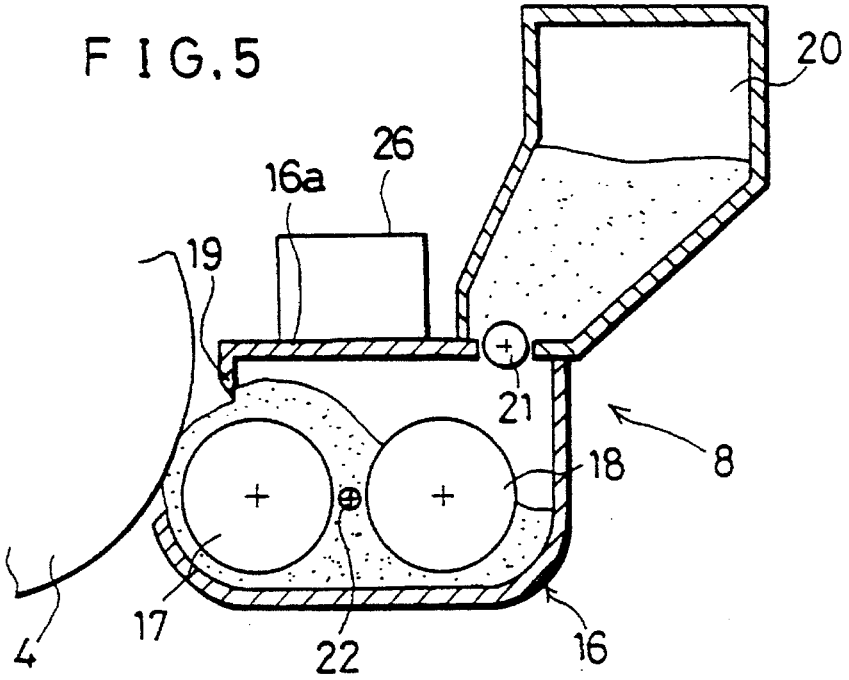

As illustrated in FIG. 5, the developing device 8 includes a developer container 16 having therein a developing roller 17 formed by a magnet roller, a stirring roller 18, and a supply and discharge shaft 22. The developing roller 17 and the stirring roller 18 are rotatably mounted. The supply and discharge shaft 22 is rotatably mounted between and parallel to the rollers 17 and 18. A developer contained in the developer container 16 includes carrier and toner. The carrier made of a magnetic substance has a resin coat layer for restraining the toner from adhering to the carrier surface. When the carrier and the toner are stirred by the stirring roller 18, the toner is charged by friction. The developing roller 17 transports the carrier by attracting the carrier with a magnetic force and forming a magnetic brush. At this time, developing is performed by supplying the toner adhering to the carrier by the Coulomb force to the photoreceptor 4 and attracting the toner to the electrostatic latent image on the photoreceptor 4. The length of the magnetic brush is regulated by a doctor 19.

An opening for the supplying of the developer is formed in a top wall 16*a* of the developer container 16. A toner supply unit (toner supply means) 20 containing toner is positioned above the opening to fit into the opening. A toner supply roller 21 is disposed at the bottom of the toner supply unit 20. As the toner supply roller 21 is driven and rotated, the toner in the toner supply unit 20 flows downward into the developer container 16 for the time during which the toner supply roller 21 is driven.

Figure 1:
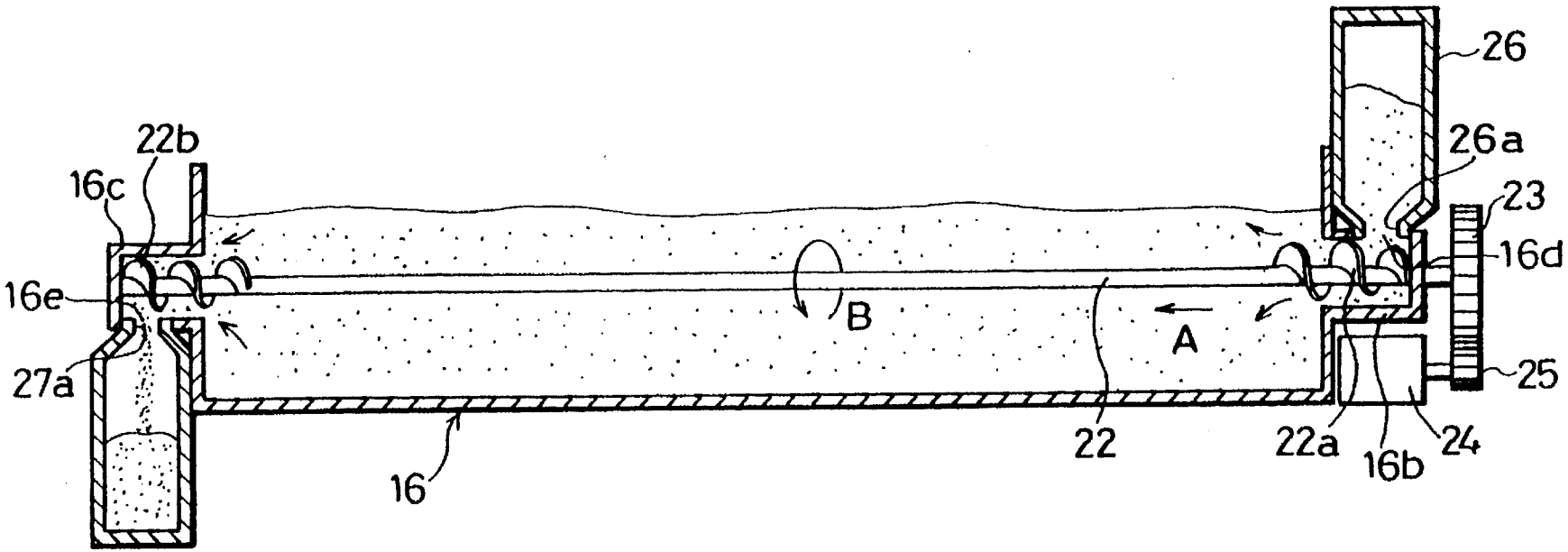
FIGS. 1 to 7 illustrate one embodiment of the present invention.
Figure 2:
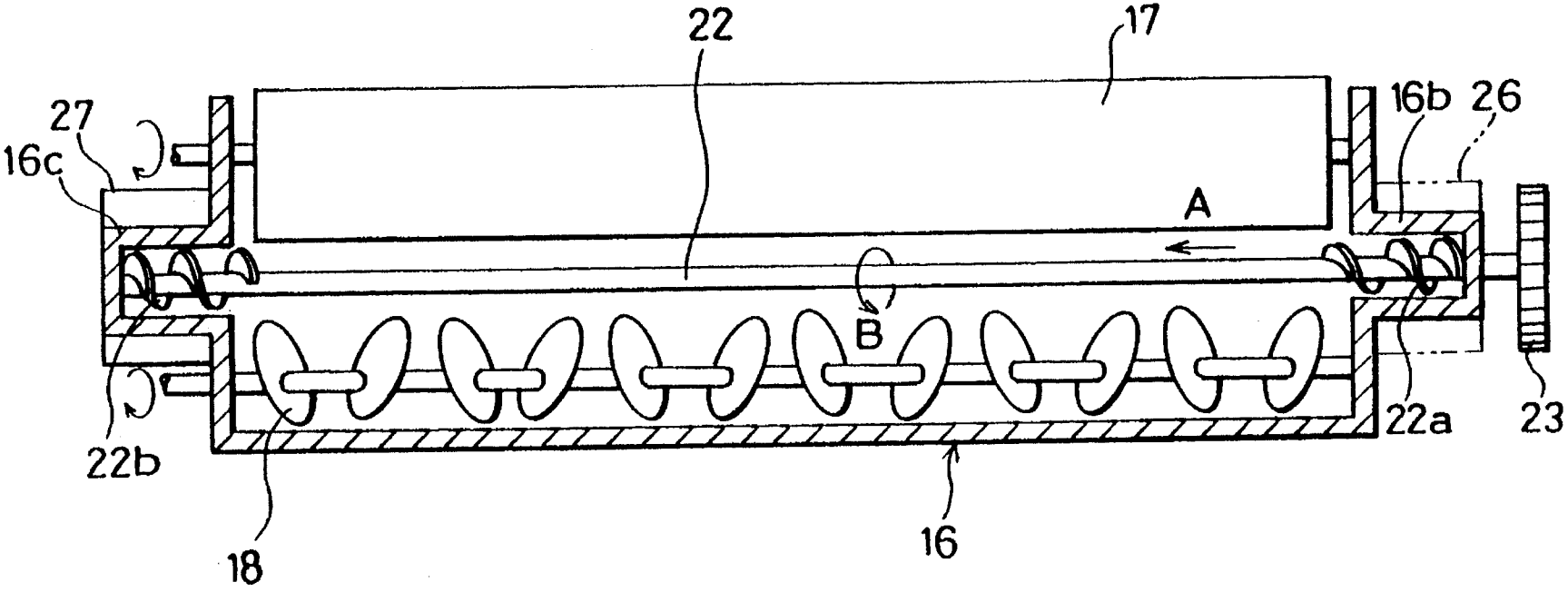

As illustrated in FIGS. 1 and 2, the developer container 16 has protruding sections 16*b* and 16*c* which stick out in the axis direction of the shaft 22 at positions corresponding to the ends of the supply and discharge shaft 22. A supply screw 22*a* as a supply transporting section is provided on one of the ends of the supply and discharge shaft 22. A discharging screw 22*b* as a discharge transporting section is provided on the other end of the supply and discharge shaft 22. These screws 22*a* and 22*b* transport the developer in the A direction with the rotation of the supply and discharge shaft 22 in the B direction.

A transporting screw may be formed between and successively with the supply screw 22*a* and the discharge screw 22*b* to be connected to these screws.

A gear 23 is mounted on one of the ends of the supply and discharge shaft 22. The gear 23 meshes with a gear 25 which is mounted on the rotation shaft of a developer supply and discharge driving motor 24. The motor 24 is controlled by a controller 32, to be described later, to rotate the supply and discharge shaft 22 only in the B direction.

Figure 3:
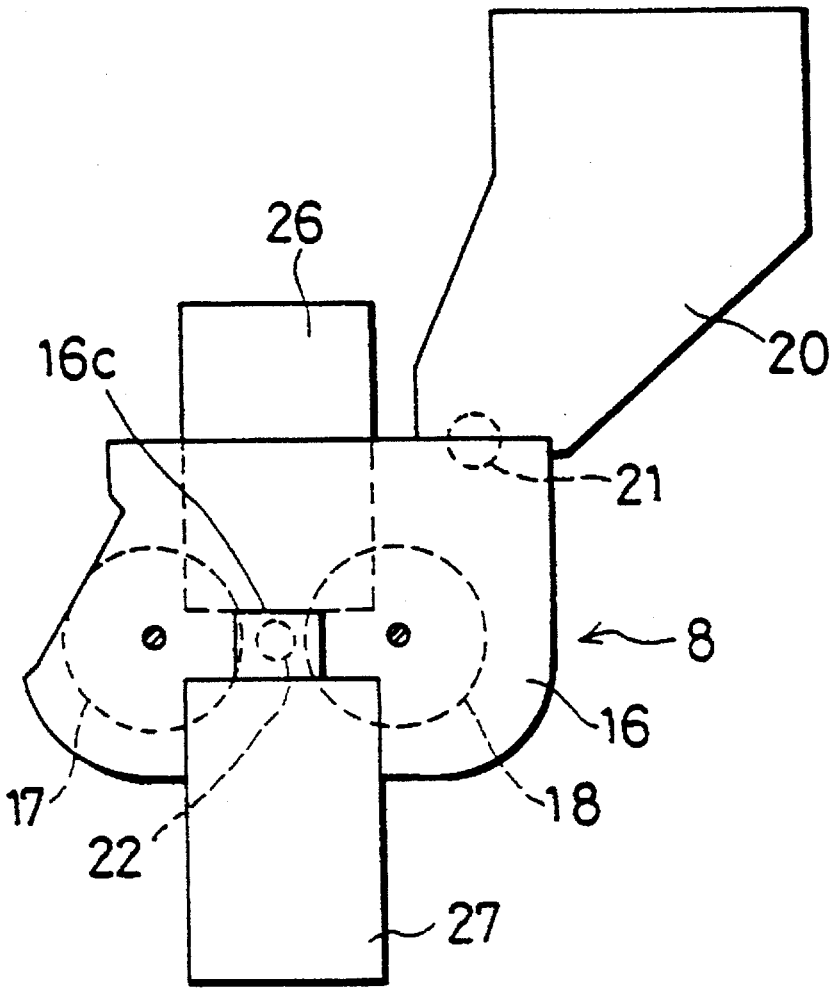

The protruding section 16*b* of the developer container 16 has a developer supply port 16d in the top wall thereof, while the protruding section 16*c* has a developer discharge port 16*e* in the bottom wall thereof. A supply opening 26*a* of a developer supply container 26 as a developer supply section shown in FIG. 3 is located above the developer supply port 16*d* and fits into the developer supply port 16*d*. A collecting opening 27*a* of a developer collecting container 27 is located under the developer discharge port 16*e* and fits into the developer discharge port 16*e*. The developer supply container 26 stores unused developer.

The toner concentration in the developer stored in the developer supply container 26 is set equal to a target toner concentration for the developer stored in the developer container 16. The geometries and diameters of the screws 22*a* and 22*b*, and the geometries and dimensions of the supply opening 26*a* and of the collecting opening 27*a* are determined so that an amount of unused developer supplied to the developer container 16 by the supply screw 22*a* becomes equal to an amount of developer discharged from the developer container 16 by the discharge screw 22*b* when the supply and discharge shaft 22 is rotated.

Next, a copying operation performed in a copying machine having the above-mentioned structure is discussed below.

When a power switch, not shown, is turned on, a warm-up operation is performed. When a copying start switch 31, to be described later, is turned on after the warm-up operation is complete, the light source lamp 3 of the exposure optical system 2 scans a document placed on the document platen 1. At this time, reflected light from the document is illuminated on the photoreceptor 4 through the reflecting mirrors 5 and the lens unit 6, and an electrostatic latent image is formed on the surface of the photoreceptor 4 which has been charged to a predetermined potential by the charger 7. Then, the electrostatic latent image is developed by the toner supplied from the developing device 8. The toner image on the surface of the photoreceptor 4 is transferred by the transfer charger 9 to a sheet supplied from the sheet feeding cassette 13, and then fused onto the sheet by the fixing device 15. Accordingly, a copied image of the image on the document is formed on the sheet.

Figure 6:
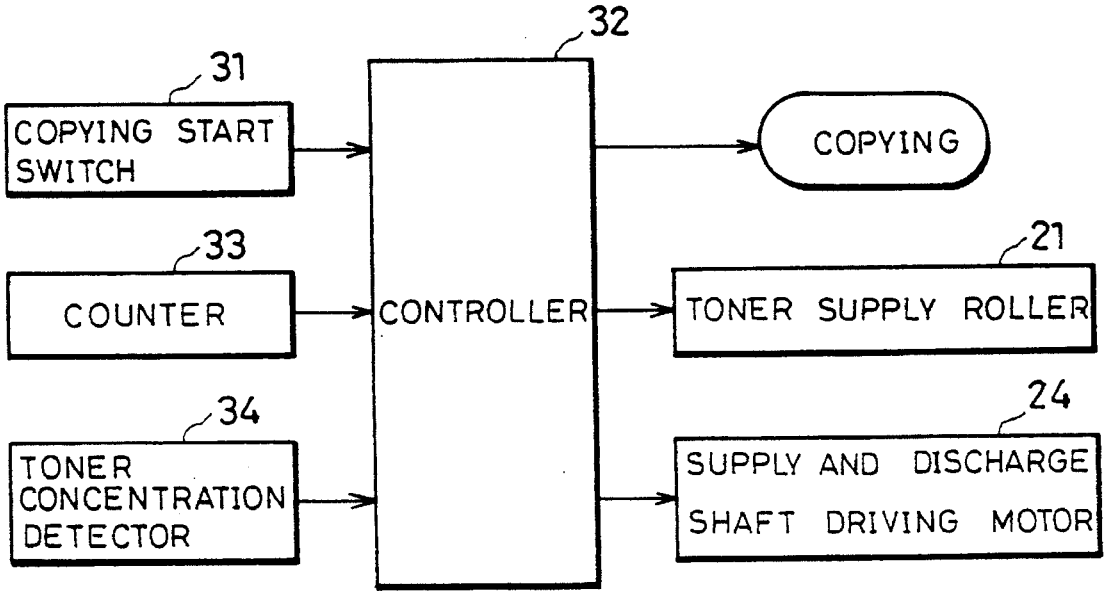
Figure 7:
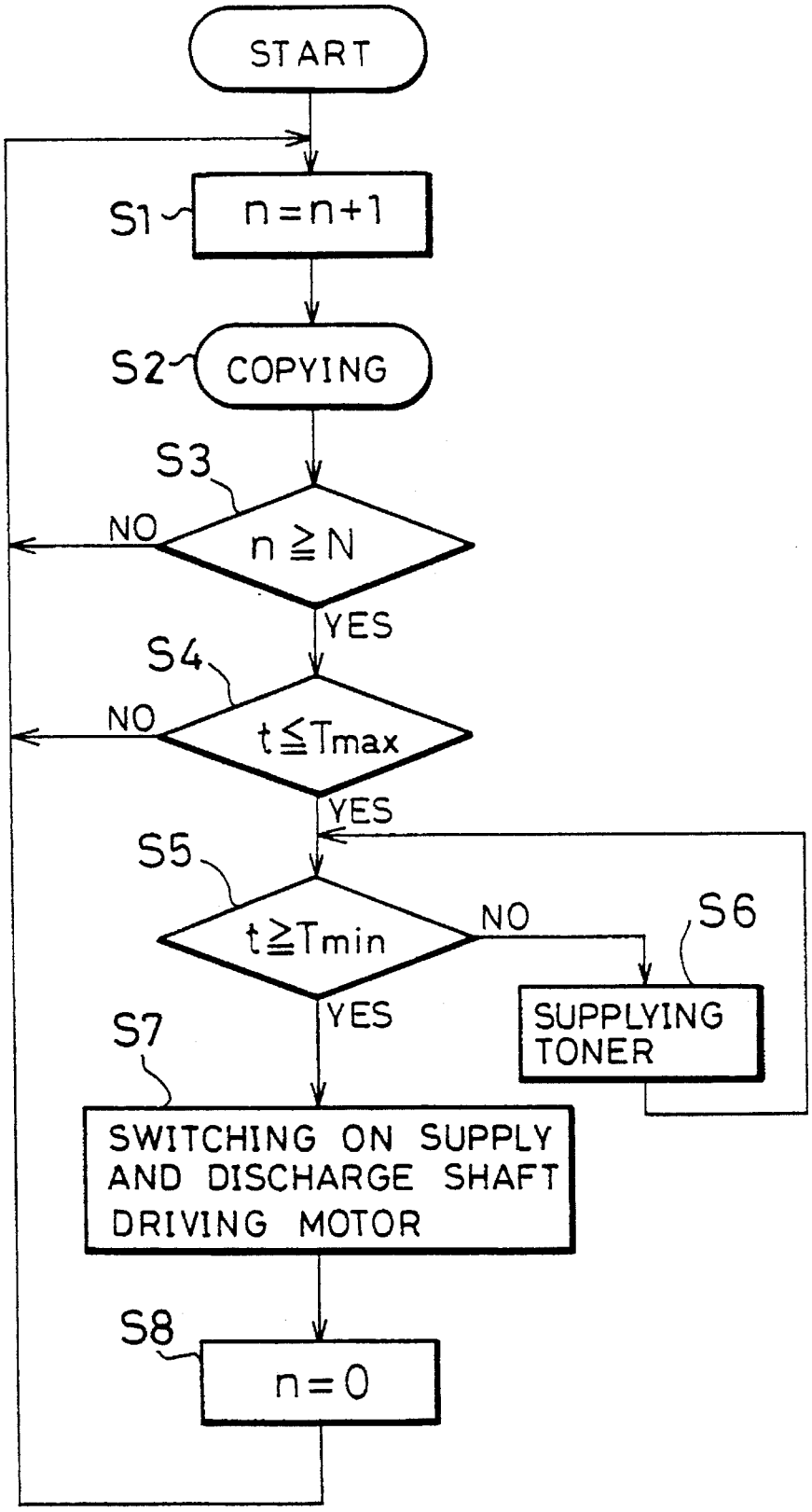

In order to control such a sequence of copying operations, as illustrated in FIG. 6, the controller 32 as controlling means including a microcomputer is incorporated into the copying machine, and a signal for turning on the copying start switch 31 is input to the controller 32. A counter 33 for counting the total number of copying operations performed is provided. A value n counted by the counter 33 (hereinafter just referred to as the copy count) is also input to the controller 32 as to be described later.

When such a copying operation is repeatedly performed, the toner in the developer stored in the developer container 16 is gradually consumed. Then, the ratio of the toner to the carrier, i.e., the toner concentration decreases. In this embodiment, a toner concentration detector 34 as toner concentration detecting means for detecting a change in the toner concentration is included in the developer container 16. The toner supply roller 21 is driven in a manner described below under the control of the controller 32 according to the output of the toner concentration detector 34.

When a signal detected by the toner concentration detector 34 indicates that the toner concentration is lowered to the lower limit of an appropriate range for development, the toner supply roller 21 starts to be driven. As a result, the toner in the toner supply unit 20 is supplied into the developer container 16, and the toner concentration in the developer container 16 is increased. When the toner concentration reaches the upper limit of the appropriate range, the toner supply roller 21 is stopped. With this control, the toner concentration in the developer container 16 is maintained within the appropriate range.

Unlike the toner, the carrier in the developer is not reduced even when it is repeatedly used for development. However, the carrier gradually deteriorates when it is stirred by the developing roller 17 and the stirring roller 18, and when it makes contact with the photoreceptor 4. As the carrier deteriorates, a predetermined charge is not given to the toner, resulting in a lowering of copy quality. If carrier is additionally supplied into the developer container 16 to replace the deteriorated carrier therein, it is possible to restrain the lowering of the charging property. Therefore, in this embodiment, upon an instruction from the controller 32, the supply and discharge shaft driving motor 24 is driven, and the supply and discharge shaft 22 is rotated. Then, unused developer including carrier is supplied from the developer supply container 26 to the developer container 16 and the developer in the developer container 16 is simultaneously discharged. The process of controlling the supplying and discharging is described in detail below with reference to FIGS. 6 and 7.

First, a value, 1, is added to the copy count n of the counter 33 upon the instruction to start a copying operation, for example, when the copying start switch 31 is turned on (step 1). This is performed every time a copying operation is performed. Then, copying is executed (step 2). The copy count n obtained in step 1 is compared with a preset developer replacement value N which is indicated by the number of copies (step 3). When the preset developer replacement value N is counted, supplying and discharging of developer is required. When the copy count n reaches the developer replacement value N, a toner concentration t detected by the toner concentration detector 34 is compared with the upper limit, i.e., a specified maximum value $T_{max}$ in the allowable range of the toner concentration t in the developer 16 (step 4). If the toner concentration t exceeds the specified maximum value $T_{max}$, the operation returns to step 1 without supplying the toner and the developer.

On the other hand, if the toner concentration t does not exceed the specified maximum value $T_{max}$ in step 4, the toner concentration t is further compared with the lower limit, i.e., a specified minimum value $T_{min}$ in the allowable range of the toner concentration t in the developer container 16 (step 5). If the toner concentration t does not reach the specified minimum value $T_{min}$, the toner supply roller 21 is rotated to supply the toner to the developer container 16 until the toner concentration t reaches or exceeds the specified minimum value $T_{min}$ (step 6).

When the toner concentration t reaches or exceeds the specified minimum value $T_{min}$ after supplying the toner to the developer container 16 in step 6, or when the toner concentration t reaches or exceeds the specified minimum value $T_{min}$ in step 5, the supply and discharge shaft driving motor 24 is actuated and the supply and discharge shaft 22 is rotated for a predetermined time (step 7). When the supply and discharge shaft 22 is rotated, the developer which reaches the supply opening 26*a* of the developer supply container 26 is put into the developer container 16 by the supply screw 22*a*. At that time, the developer in the developer container 16 is discharged from the developer discharge port 16*e* into the developer collecting container 27 by the discharge screw 22*b*.

Since the developer supply port 16*d* is formed in a portion below the surface of the layer of the developer, the developer in the developer supply container 26 can never be supplied into the developer container 16 when the supply and discharge shaft 22 is stopped.

Subsequently, the copy count n returns to 0 (step 8), and the operation returns to step 1.

As described above, by repeatedly performing the supplying of unused developer and the discharging of used developer, the deteriorated developer in the developer container 16 is consecutively replaced with new developer.

In the developing device of this embodiment, the supplying and discharging of developer is accurately performed in accordance with the rotating time and the rotation speed of the supply and discharge shaft driving motor 24, i.e., the rotation time and the rotation speed of the supply and discharge shaft 22. Therefore, unlike the supplying and discharging of developer by an overflowing mechanism, the developer is accurately discharged even if the surface level of the developer is changed, for example, is reduced to a great degree due to a change in the total amount of developer in the developer container 16.

Additionally, the same amount of developer is simultaneously supplied and discharged.

With this structure, the replacement of the deteriorated developer in the developer container 16 with newly supplied developer is easily and accurately controlled to obtain a desired replacement ratio. It is therefore possible to keep the charging property of developer at a substantially uniform level, maintaining favorable copy quality.

Unlike the supplying and discharging of developer by the overflowing mechanism, the discharging of developer soon after the supplying of the developer rarely occurs. Consequently, the efficiency of replacing the developer is improved and the consumption of the developer is reduced.

Moreover, even when a copying machine incorporating the developing device receives an impact or tilted at the time the copying machine is moved, a large amount of developer is seldomly discharged from the developer container 16. It is therefore possible to prevent a considerable change in the amount of developer from causing substantial changes in the charging property and in the copy quality.

The developing device of this embodiment not only solves the above-mentioned problems but also has the following advantages.

More specifically, the toner concentration in the developer supplied from the developer supply container 26 is set equal to a target toner concentration for the developer in the developer container 16. The toner concentration in the developer in the developer container 16 is easily controlled because it does not deviate from the target value as a result of the supply of the developer from the developer supply container 26.

When the toner concentration in the developer in the developer container 16 is out of the allowable range, the developer is not supplied nor discharged until the toner concentration comes into the allowable range. Therefore, in the condition having an amount of toner which is less than is needed, it is possible to prevent an increased amount of carrier from being discharged by the rotation of the supply and discharge shaft 22 in comparison with the condition where the toner concentration is within the allowable range, avoiding a shortage of carrier in the developer container 16. Similarly, in the condition having an excessive amount of toner, it is possible to prevent a reduced amount of carrier from being discharged by the rotation of the supply and discharge shaft 22 in comparison with the condition where the toner concentration is within the allowable range, thereby avoiding the developer container 16 from containing an excessive amount of carrier. In short, even when the toner concentration in the developer container 16 is out of the allowable range, the charging property of the developer is not changed, thereby preventing the copy quality from deteriorating.

Moreover, since the developer is supplied and discharged simultaneously by the rotation of the supply and discharge shaft 22, the structure of supplying and discharging developer is simplified in comparison with a conventional structure.

The following description discusses an alternative embodiment of the present invention with reference to FIGS. 8 to 12. The members having the same function as in the above-mentioned embodiment will be designated by the same code and their description will be omitted.

Figure 10:
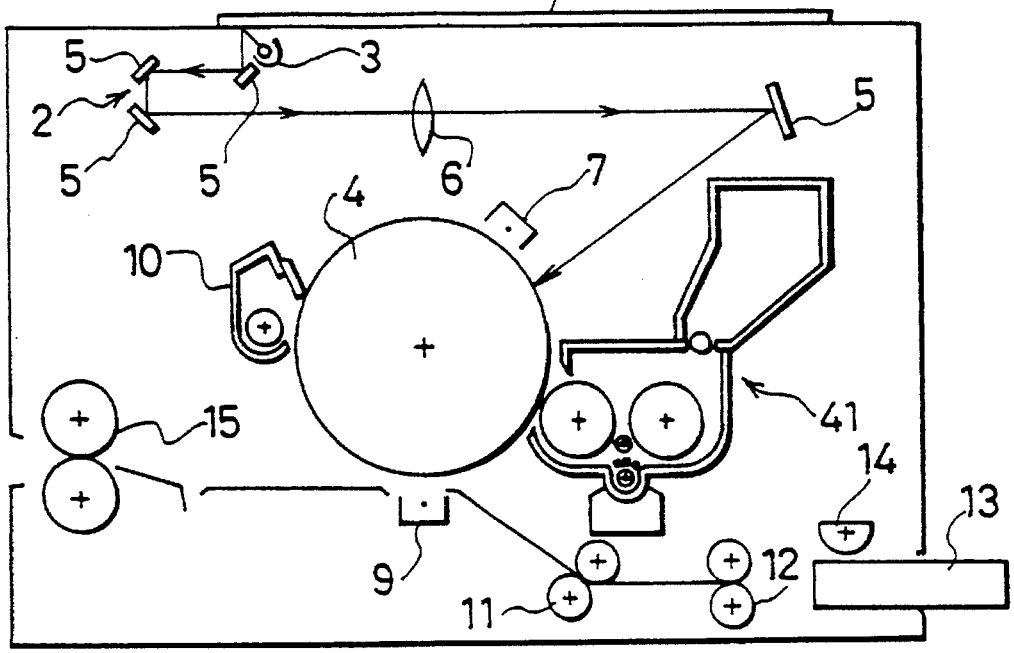

As illustrated in FIG. 10, a copying machine incorporating a developing device of this embodiment has a structure substantially similar to that of the copying machine of the above-mentioned embodiment except for a developing device 41. The copying machine of this embodiment produces a copied image of the image on a document placed on the document platen 1 on a sheet supplied from the sheet feeding cassette 13.

Figure 11:
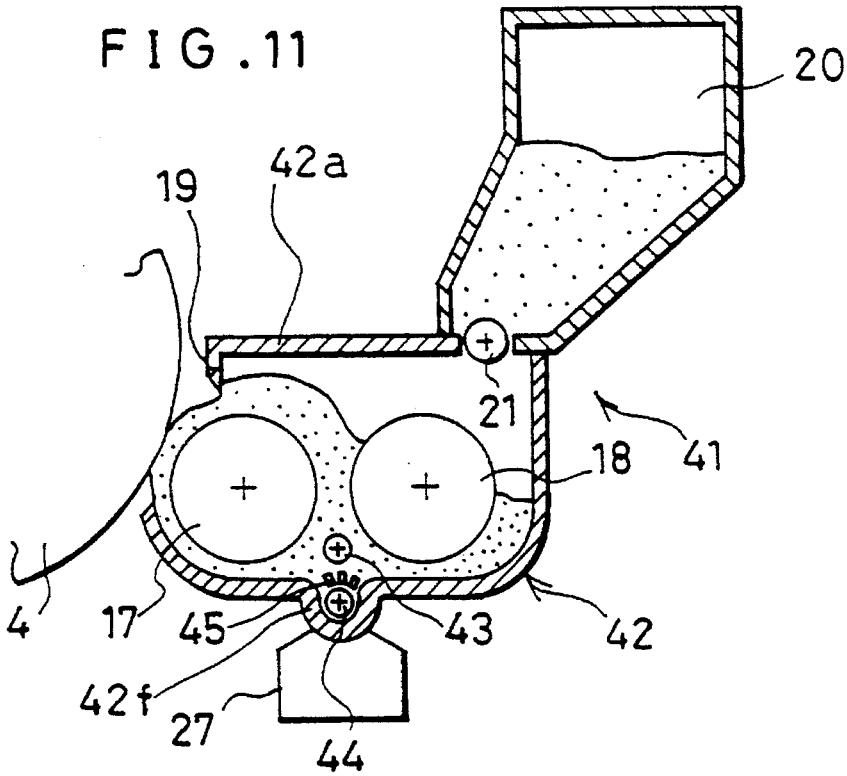

As shown in FIG. 11, a supply shaft 43 is rotatably mounted between and in parallel with the developing roller 17 and the stirring roller 18 located in a lower central part of the developer container 42 in the developing device 41. A discharge shaft 44 which is parallel with the supply shaft 43 is rotatably mounted below the supply shaft 43 in a sleeve 42*f*. The sleeve 42*f* is provided at a bottom part of the developer container 42 for the installation of the discharge shaft 44.

Figure 8:
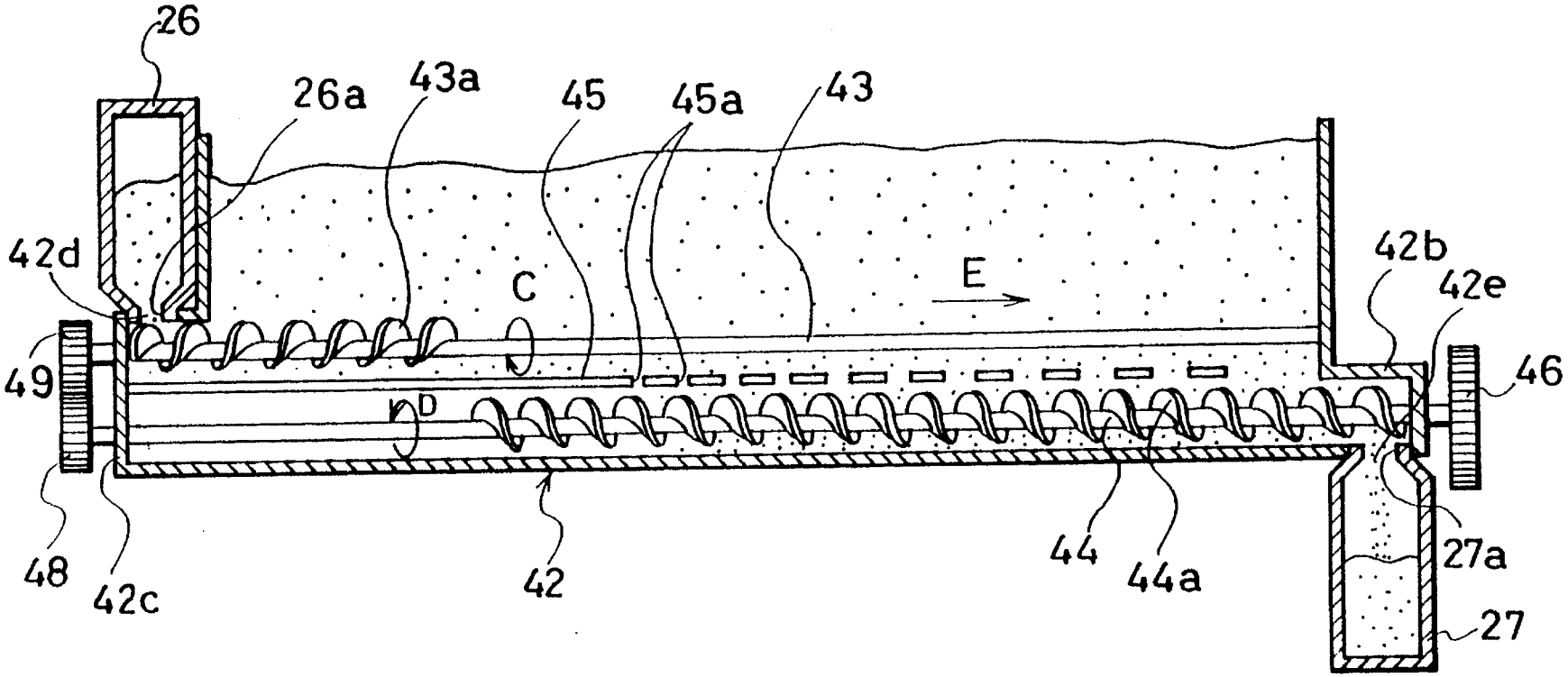
FIGS. 8 to 12 illustrate an alternative embodiment of the present invention.
Figure 9:
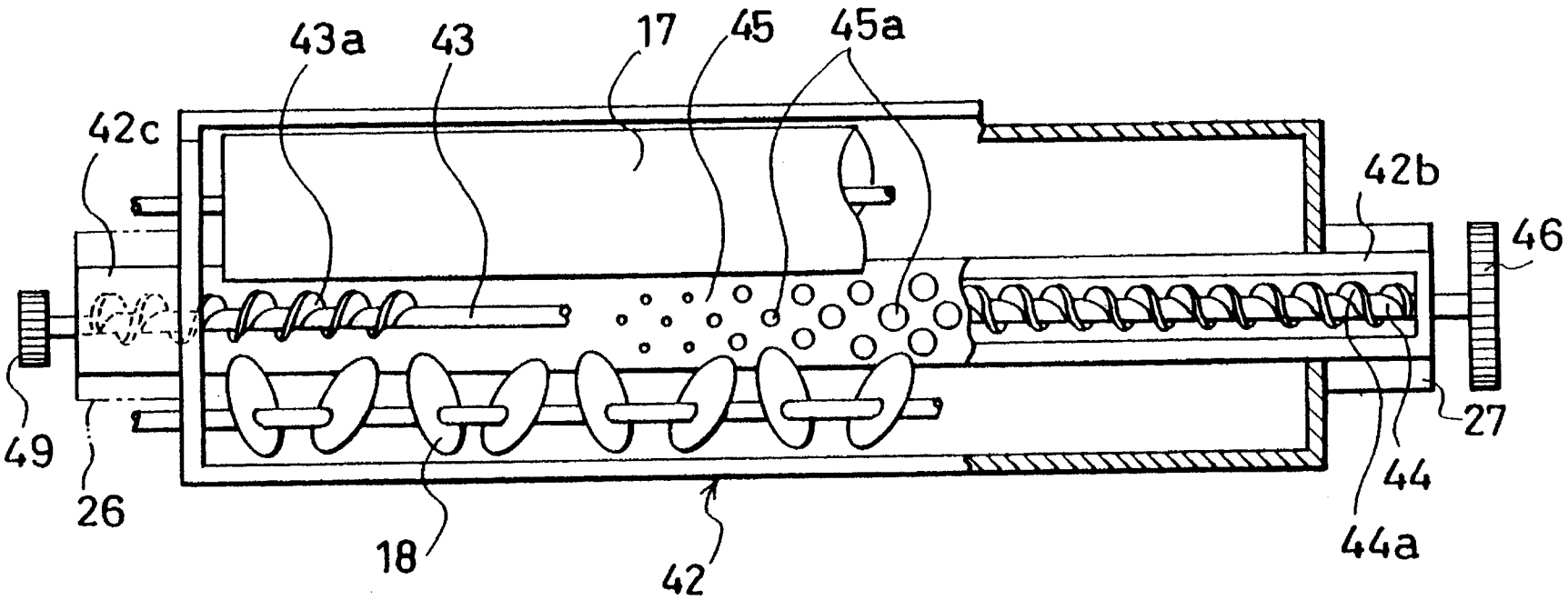

As illustrated in FIGS. 8 and 9, portions of the developer container 42 corresponding to the ends of the discharge shaft 44 extend in the axis direction of the discharge shaft 44 to form protruding sections 42*b* and 42*c*. Not only one of the ends of the discharge shaft 44, but also one of the ends of the supply shaft 43 are positioned in the protruding section 42*c*.

As illustrated in FIGS. 8, 9 and 11, a partition member 45 is mounted over the sleeve 42*f* storing the discharge shaft 44. The partition member 45 entirely covers the sleeve 42*f* and separates the developer container 42 into a portion having the supply shaft 43 and a portion having the discharge shaft 44.

The partition member 45 has a communicating hole 45*a*. The partition member 45 has no hole from one of the ends thereof fixed to the protruding section 42*c* to near the center, but has communicating holes 45*a* from substantially the center toward the end located on the protruding section 42*b* of the developer container 42. The diameter of the communicating holes 45*a* gradually increases toward the protruding section 42*b*.

As shown in FIGS. 8 and 9, the supply shaft 43 has a supply screw (supply transporting section) 43*a* extending from the end of the supply shaft 43 positioned in the protruding section 42*c* to near center thereof. The discharge shaft 44 has a discharge screw (discharge transporting section) 44*a* which extends in the axis direction of the discharge shaft 44 from the end of the discharge shaft 44 located in the protruding section 42*b* to near center and is longer than the supply screw 43*a*. Shortly, the discharge screw 44*a* is provided in a portion of the discharge shaft 44 corresponding to a portion of the supply shaft 43 where the supply screw 43*a* is not provided, and the supply screw 43*a* is provided in a portion of the supply shaft 43 corresponding to a portion of the discharge shaft 44 having no discharge screw 44*a*. The supply screw 43*a* transports the developer in the E direction with the rotation of the supply shaft 43 in the C direction, while the discharge screw 44*a* transports the developer in the E direction with the rotation of the discharge shaft 44 in the D direction.

A driving gear 46 is mounted on the end of the discharge shaft 44 positioned in the protruding section 42*b*. The driving gear 46 meshes with a gear, not shown, mounted on the rotation shaft of a discharge-shaft driving motor 47 as driving means. Like the above-mentioned embodiment, the discharge-shaft driving motor 47 rotates the discharge shaft 44 only in the D direction under the control of the controller 32.

A transmission gear (transmitting means) 48 is mounted on the end of the discharge shaft 44 positioned in the protruding section 42*c*. The transmission gear 48 meshes with a transmission gear (transmitting means) 49 mounted on the end of the supply shaft 43 positioned in the protruding section 42*c*. The ratio of the transmission gear 48 to the transmission gear 49 is 1 to 1, i.e., the change gear ratio of the supply shaft 43 and the discharge shaft 44 is 1. When the rotation driving force is transmitted to the supply shaft 43 by the transmission gear 49, the supply shaft 43 is rotated only in the C direction.

The geometry and diameter of each of the screws 43*a* and 44*a*, and the geometries and the dimensions of the supply opening 26*a* and of the collecting opening 27*a* are determined so that the amount of unused developer supplied to the developer container 42 by the supply screw 43*a* with the rotation of the supply shaft 43 becomes equal to the amount of developer discharged from the developer container 42 by the discharge screw 44*a* with the rotation of the discharge shaft 44.

Figure 12:
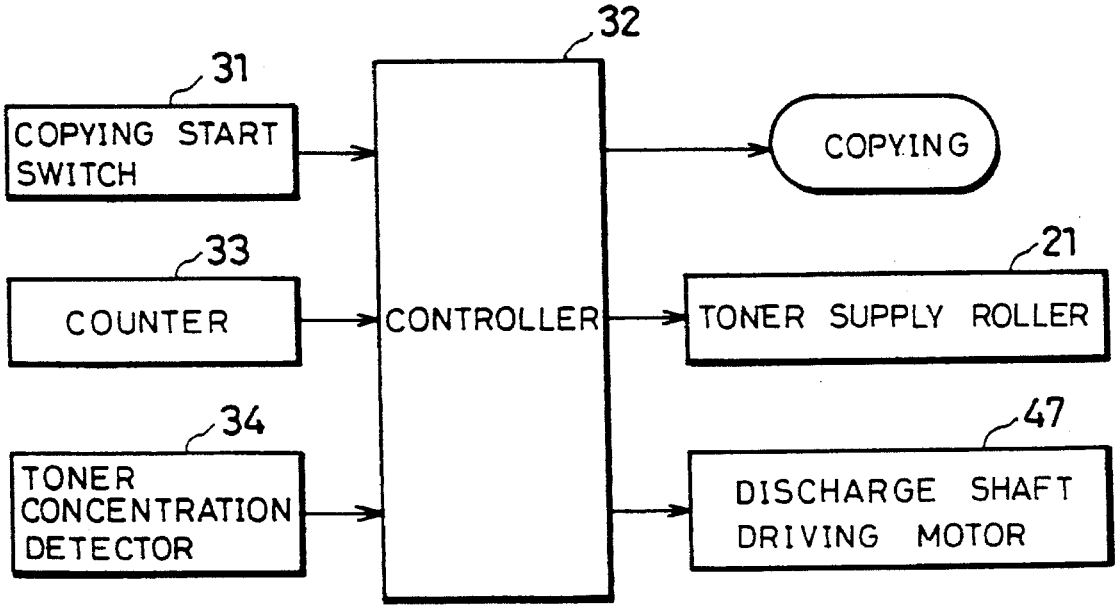

As illustrated in FIG. 12, in the copying machine of this embodiment, the copying operation is controlled by the controller 32 constituted by a microcomputer like the above-mentioned embodiment. The toner supply roller 21 and the discharge-shaft driving motor 47 are also driven under the control of the controller 32.

The rotation of each of the supply shaft 43 and the discharge shaft 44 is controlled by the controller 32 in a manner described in the above-mentioned embodiment. More specifically, when a count shown in the counter 33 reaches the developer replacement value and when the toner concentration in the developer in the developer container 42 detected by the toner-concentration detector 34 is within the allowable range, the controller 32 permits the discharge-shaft driving motor 47 to operate for a predetermined time. As a result, the discharge shaft 44 is rotated. Then, the rotation of the discharge shaft 44 is transmitted to the supply shaft 43 by the transmission gears 48 and 49, and the supply shaft 43 is rotated.

When the supply shaft 43 is rotated, unused developer reaching the supply opening 26*a* of the developer supply container 26 is brought into the developer container 42 by the supply screw 43*a*. When the discharge shaft 44 is rotated, the developer which has passed through the communicating holes 45*a* in the partition member 45 is discharged through the discharge port 42*e* into the developer collecting container 27 by the discharge screw 44*a*.

Like the above-mentioned embodiment, since the developer supply port 42*d* is located lower than the surface of the developer layer in the developer container 42, the developer in the developer supply container 26 can never be supplied into the developer container 42 when the supply shaft 43 and the discharge shaft 44 are stopped. By repeatedly performing the supplying of unused developer and the discharging of used developer, the deteriorated developer in the developer container 42 is consecutively replaced with new developer.

As a result, in the developing device of this embodiment, like the above-mentioned embodiment, even when the total amount of the developer in the developer container 42 is changed and the surface level of the developer is varied, an amount of developer corresponding to the driving time of the discharge-shaft driving motor 47 is precisely supplied and discharged. Consequently, the ratio of replacing the deteriorated developer with the new developer is controlled in a desired manner. This enables the charging property to be kept substantially uniform, maintaining a good copy quality.

Moreover, like the above-mentioned embodiment, when moving a copying machine incorporating the developing device, the discharging of an excessive amount of developer due to the impact or tilt of the machine is avoided. It is also possible to prevent a change in the charging property and a considerable change in copy quality from being caused by a considerable change in the amount of developer.

Similar to the above-mentioned embodiment, since the toner concentration in the developer stored in the developer supply container 26 is set equal to a target toner concentration for the developer in the developer container 42, the toner concentration is easily controlled not to largely differ from the target toner concentration even after the supplying of developer from the developer supply container 26.

Additionally, like the above-mentioned embodiment, with the structure in which the supplying of the developer from the developer supply container 26 and the discharging of the developer into the developer collecting container 27 are not performed when the toner concentration in the developer in the developer container 42 is out of the allowable range, a change in the charging property which is caused by excess and shortage of carrier is restrained, and thereby preventing the copy quality from deteriorating.

Furthermore, since the partition member 45 between the supply shaft 43 and the discharge shaft 44 has the communicating holes 45*a* whose diameter is gradually increased from the upper stream toward the lower stream in the transporting direction of the developer, fine developer which deteriorates the copy quality is initially discharged, thereby restraining the degree of deterioration of copy quality.

In this embodiment, the supply shaft and the discharge shaft are positioned so that one is located above the other, and the developer supply container and the developer collecting container are provided in the same way as in the developing device of the above-mentioned embodiment. However, the arrangement of the supply shaft and the discharge shaft are not particularly restricted to this. Accordingly, the following advantages are achieved.

In the above-mentioned embodiment, since the supply screw and the discharge screw are provided on the same shaft, the developer supply container and the developer collecting container are restricted to be located in positions corresponding to the ends of the supply and discharge shaft. Namely, the structure of the developing device including the geometry and dimensions is restricted.

In this embodiment, however, since the supply screw and the discharge screw are provided on separate shafts, there is no structural restriction. Thus, the positions of the developer supply container and the developer collecting container are freely determined. As a result, structure of the developing device including the geometry and dimensions is more freely designed. In this case, the positions of the supply shaft and the discharge shaft are determined according to the positions of the developer supply container and the developer collecting container.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A developing device comprising:

a developer container for storing developer having toner and carrier;

a developer supply section, connected to a wall surface of said developer container, for supplying developer to said developer container, the developer supply section having a structure to set a ratio of toner to carrier in the developer contained in said developer supply section to be equal to a target ratio of toner to carrier in the developer contained in the developer container; and a toner supply unit, connected to a wall surface of said developer container, for supplying toner to said developer container, wherein said developer container includes:

a supply transporting section, disposed inside said developer container at a location in vicinity of said developer supply section, for transporting the developer supplied from the developer supply section into said developer container;

a discharge opening, formed in a wall surface of said developer container;

a discharge transporting section, disposed inside said developer container at a location in vicinity of said discharge opening, for transporting the developer in said developer container to said discharge opening; and a driver for driving at least one of said supply transporting section and said discharge transporting section.

2. The developing device according to claim 1, wherein said supply transporting section and said discharge transporting section are screws having the same geometry and dimensions.

3. The developing device according to claim 1, further comprising:

a toner concentration detector for detecting a toner concentration indicating a ratio of toner to carrier in said developer container; and a controller for controlling said driving means so that the toner is supplied when a toner concentration detected by said toner concentration detector becomes lower than a lowest value in a predetermined allowable range, and that a portion of the developer in said developer container is discharged by said discharge transporting section and the developer in said developer supply container is supplied to said developer container by said supply transporting section when the toner concentration is within the predetermined allowable range.

4. The developing device according to claim 1, wherein said developer container further comprises:

a supply and discharge shaft mounted inside said developer container, said supply and discharge shaft being driven by said driver and rotated in one direction, wherein said supply transporting section and said discharge transporting section are located at ends of said supply and discharge shaft respectively, and driven when said supply and discharge shaft is rotated by said driver.

5. The developing device according to claim 4, wherein said supply and discharge shaft is substantially horizontally mounted.

6. The developing device according to claim 4, wherein each of said supply transporting section and said discharge transporting section are formed by a single uninterrupted screw.

7. The developing device according to claim 1, wherein said developer container further comprises a supply shaft having said supply transporting section;

a discharge shaft having said discharge transporting section; and a transmitter for transmitting a rotation driving force of said driver applied to one of said supply shaft and said discharge shaft to the other of said supply shaft and said discharge shaft so that said other shaft is driven and rotated by said driver.

8. The developing device according to claim 7, wherein said supply transporting section and said discharge transporting section are screws having the same geometry and dimensions, and said transmitter is formed by a gear with a change gear ratio of 1.

9. The developing device according to claim 7, wherein both of said supply shaft and said discharge shaft are substantially horizontally mounted.

10. The developing device according to claim 7, wherein said supply shaft and said discharge shaft are mounted on a plane extending in a perpendicular direction.

11. The developing device according to claim 7, wherein said supply shaft and said discharge shaft are mounted parallel to each other, and said supply shaft is mounted in a level higher than a level where said discharge shaft is located.

12. The developing device according to claim 7, wherein said developer container further comprises:

a partition member mounted therein, said partition member having communicating holes through which the developer is transported toward said discharge transporting section, said communicating holes having a diameter which gradually becomes larger from an upper stream toward a lower stream in a transporting direction of the developer, and said developer container is divided into an upper section and a lower section by said partition member, one of said sections having said supply shaft and the other section having said discharge shaft.

* * * * *